US005430421A

United States Patent [19]

Bornand et al.

[11] Patent Number: 5,430,421

[45] Date of Patent: Jul. 4, 1995

[54] REED CONTACTOR AND PROCESS OF FABRICATING SUSPENDED TRIDIMENSIONAL METALLIC MICROSTRUCTURE

[75] Inventors: Etienne Bornand, Boudry; Jean-Luc Simon, Neuchatel, both of Switzerland

[73] Assignee: Asulab S.A., Bienne, Switzerland

[21] Appl. No.: 166,359

[22] Filed: Dec. 14, 1993

[30] Foreign Application Priority Data

Dec. 15, 1992 [FR] France ..... 92 15213
Jul. 2, 1993 [CH] Switzerland ..... 1991/93

[51] Int. Cl.[6] ..... H01H 1/66
[52] U.S. Cl. ..... 335/154; 335/151
[58] Field of Search ..... 335/151-153, 335/154

[56] References Cited

U.S. PATENT DOCUMENTS 3,974,468 8/1976 Ygfors .
4,063,203 12/1977 Fujiwara et al. ..... 335/151
4,899,439 2/1990 Potter et al. .
4,909,909 3/1990 Florjancic .
4,915,983 4/1990 Lake et al. .
4,920,639 5/1990 Yee .
5,092,032 3/1992 Murakami .

FOREIGN PATENT DOCUMENTS 248454 4/1986 Germany .
8804877 6/1988 WIPO .

*Primary Examiner*—Lincoln Donovan
*Attorney, Agent, or Firm*—Griffin, Butler Whisenhunt & Kurtossy

[57] ABSTRACT

A reed contactor includes a base plane comprising two distinct conducting zones. Two shafts of the contactor have the form of blades, each of which engages a base plane at the level of one of the conducting zones. One of the beams at least is supported on the base plane by means of a foot on which it is mounted in an overhanging manner. The contactor is formed by process comprising the steps of forming successively on a substrate an alternance of levels of photoresist and of metallization. At each step, the level of upper photoresist is configured to create in its thickness free growth spaces in which metal pins are formed by galvanic growth. The levels of photoresist situated under the last level of metallization play the role of sacrificial layers and allow the formation of suspended metallic structures.

8 Claims, 9 Drawing Sheets

REED CONTACTOR AND PROCESS OF FABRICATING SUSPENDED TRIDIMENSIONAL METALLIC MICROSTRUCTURE

The present invention concerns a "shaft" or "reed" contactor, that is to say a contactor including a closed chamber in the interior of which are mounted two conducting shafts or beams connected respectively to two electrical connection means accessible from the exterior of said chamber, and recall means to, in the absence of a magnetic field, recall the shafts towards a rest position in which their distal parts are separated from each other by a space. The shafts or beams further being at least partially realized in a material having a high magnetic sensitivity such that in the presence of an exterior magnetic field of sufficient intensity, their distal parts are brought into contact with each other thus establishing an electrical contact between said connection means.

The invention also concerns two processes of fabrication, by a galvanic method, of metallic tridimensionnal microstructures suspended above a substrate, and notably of the above-mentioned "reed" contactor.

Contactors of the type described above are already known, the "reed" or "shaft" contactors being in fact electrical components currently available in commerce. They are most often intended for use in relays in association with a coil which is able to produce a magnetic field. Such a relay is constituted by a reed contactor and a coil, and is called a "reed" relay.

The known contactors are most often constituted by two ferromagnetic steel shafts, having a small diameter, disposed in the extension of each other and maintained in an engaging relation with each other by each having one of its two extremities fixed in a generally cylindrical evacuated glass bulb.

The two steel shafts traverse the two walls in which they are respectively fixed, their extremities being free from the interior wall, and extend facing each other in over-hanging manner in the interior of the glass chamber. The extremities of the steel shafts are further laminated in the form of two flexible blades whose extremities cross each other. In a rest position, that is to say notably in the absence of an exterior magnetic field, a space of some tenths of a millimeter separates the two blades from each other. In the presence of an exterior magnetic field of sufficient intensity having a component parallel to the orientation of the two shafts, the shafts will become magnetized. The two shafts being arranged substantially in the extension of each other, they would be magnetized in the same direction and the free ends of the two shafts will become respectively a north pole and a south pole. This would cause the appearance of an attractive magnetic force between the two extremities which will consequently be brought and maintained in contact with each other whilst the exterior magnetic field subsists.

Whilst being satisfactory in many applications, such contactors have the inconvenience of being too large for certain other applications. Among these applications can be mentionned in particular the end position detectors for many microtechnical applications. The exterior dimensions of such a contactor are in fact typically about 15 mm for the length of the cylindrical glass bulb and about 2 to 3 mm for the diameter of the cylindrical glass bulb. The two blades, made from a magnetic alloy, have typically a diameter before lamination of 0.5 mm. It is not possible to greatly reduce the dimensions of a construction such as has just been described. In fact, it is in particular necessary that at the same time that the dimensions of the contact are reduced, the precision with which the relative position of the two shafts is determined increases proportionally. If this was not the case, the distal extremities of the two shafts would be in danger of either permanently touching each other or being separated by too large a space to allow the closure of the contact even in the presence of a high magnetic field. In known "reed" contactors, the two shafts are, as has been stated, maintained in an engaged relation with each other by being fixed in the wall of the chamber in which they are enclosed and it is this fixation which determines the relative position. The glass bulb serving as chamber being realized by the working of glass, the fabrication tolerances are too large and it is almost impossible to obtain a relative positionning of the two shafts for which the precision will be better than some tenths of a millimeter.

An aim of the present invention is thus to overcome he inconveniances which have just been described by providing a "reed" contactor having very small dimensions which is at least as reliable as known "reed" contactors.

Another aim of the invention is to provide a process for the fabrication of metallic tridimensionnel microstructures suspended above a substrate, and in particular a process for the fabrication of thin shafts or beams of ferromagnetic material suspended above a substrate.

Thus, an object of the present invention is a contactor including two conducting beams connected respectively to electrical connection means, said beams each comprising a distal extremity, said distal extremities being next to each other and mobile with respect to each other between a first opened position in which they are separated from each other by a space, and a second closed position in which they are in contact with each other, said contactor further comprising recall means for recalling said distal extremities towards said opened position, said beams being realized at least partially in a magnetisable material such that when said beams are submitted to a magnetic induction field of sufficient intensity, said distal extremities are brought to said closed position, said contactor being characterised in that it comprises a base plane comprising two distinct electrically conducting zones, in that said beams engage said base plane at the level of said two conducting zones, and in that at least one of said beams is supported on said base plane by means of a foot on which it is mounted.

The two contact beams or contact blades, according to the present invention, engaging a base plane and no longer the wall of a bulb, the relative positioning is much more precise. In addition, the construction according to the invention which has just been described lends itself to a fabrication by micromachining with the aid of sacrificial layers and more particularly by a technique using electrodeposition operations, and notably with the aid of the object process of the present invention.

In fact, an object of the present invention is also a first process of fabrication by galvanic method of tridimensionnal metallic microstructures suspended from a substrate, characterised that it comprises the steps of:

a) creating a first layer of photoresist on one face of said substrate;

b) configuring said first layer of photoresist so as to realize in its thickness at least a free growth space revealing said face of said substrate;

c) growing by electrodeposition a metal contact in the interior of said free space, until the emergence of the metal at the surface of the photoresist;

d) creating a metallisation level at the surface of said first layer of photoresist;

e) depositing a new layer of photoresist on said metallisation level;

f) configuring said new layer of photoresist so is to realize in its thickness at least a free growth space revealing said metallisation level;

g) growing by electrodeposition a metal contact in the interior of said free space realized in said new layer of photoresist;

h) eliminating the layers of photoresist and the non-functional part of the metallisation layers.

According to this process, a given layer of photoresist fulfills firstly the function of "mould" or "mask" for the galvanic growth and thereafter in the case where a new layer of photoresist is deposited on the first, it fulfills the role of sacrificial layer. The same layer fulfills successively the function of "mould" and that sacrificial layer, the process lending itself to an iterative repetition to realize structures including any number of layers.

A further object of the present invention is a second process of fabrication by galvanic method of tridimensionnal metallic microstructures suspended from a substrate, characterised in that it comprises the steps of :

a) depositing a first substantially uniform layer of photoresist on the surface of a substructure comprising said substrate, said surface of the substructure having at least one conducting zone;

b) configuring said first layer of photoresist so as to realize in its thickness at least a free space revealing at least partially said conducting zone;

c) recovering the configured layer with an uninterrupted metallisation extending over said revealed conducting zone as well as over said layer of photoresist;

d) depositing a new layer of substantially uniform photoresist;

e) configuring said new layer of photoresist so as to realize in its thickness at least a free growth space revealing said metallisation;

f) growing by electrodeposition a metal contact in the interior of said free space realized in said new layer of photoresist;

g) eliminating the layers of photoresist and the non-functionnal parts of metallisation.

With this second process, as with the first, the same layer of photoresist can play, firstly, the role of mould or mask for the galvanic growth and, secondly, the role of sacrificial layer. Further, the metallisation covering a layer of configured photoresist being according to this last process, in direct contact with a revealed conducting zone (c.f. point C), this metallisation is in electrical contact with the lower conducting zone without it being necessary to foresee a block of metal to connect it thereto. This final characteristic allows the elimination of at least one electrodeposition step with respect to what is necessary with the first process.

Other characteristics and advantages of the invention will appear from the reading of the detailled description which follows, given as an example only, and taken in reference to the attached drawings in which.

Figure 1:
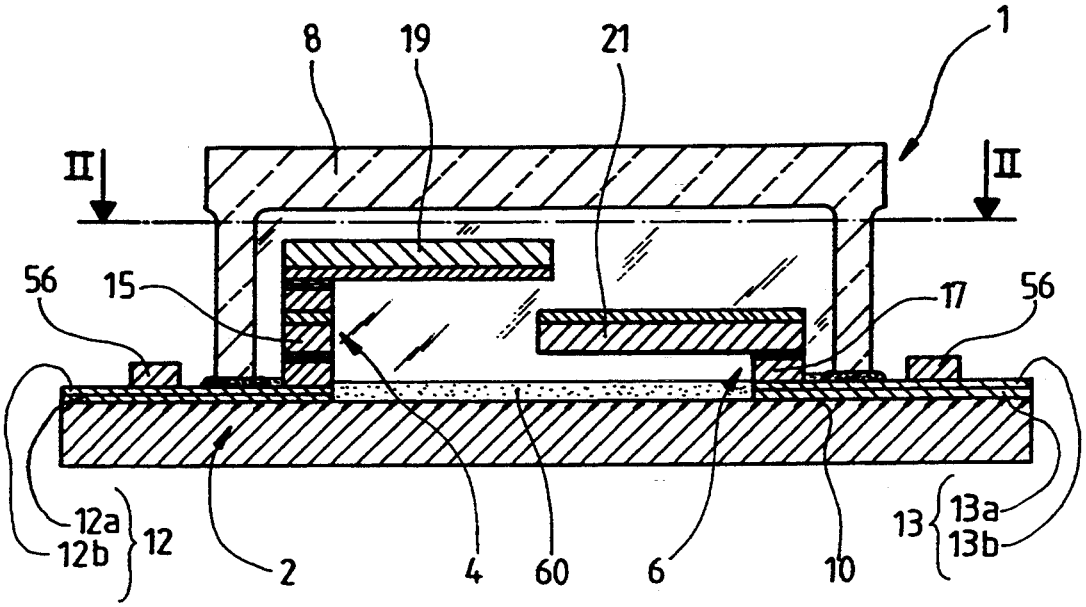
FIG. 1 is a cross-sectional side view of a "reed" contactor of a first embodiment of the present invention.
Figure 2:
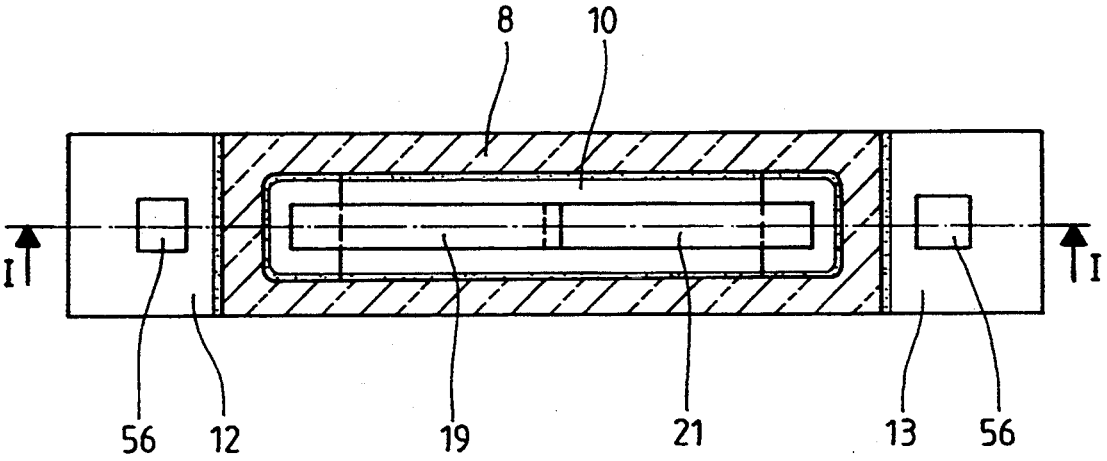
FIG. 2 is a cross-sectional plan view taken along II—II of FIG. 1.

Refering now to FIGS. 1 and 2, which represent a "reed" contactor 1 according to the invention, it can be seen that the reed contactor 1 is formed by a base plane 2 on which are supported two beams 19, 21. It can be seen more precisely that the two beams 19, 21 engage the base plane 2 by means of two feet, referenced respectively 15 and 17. Each beam 19 to 21 forms with the foot to which it is fixed an electrode structure (referenced 4 and 6 respectively). A cap 8 recovers these two electrodes and forms with the base plane, an hermetic chamber therefore. As will be seen further on, the "reed" contactors according to the present embodiment of the invention are preferably fabricated by lots or batches on plates or wafers of silicon and are, at the end of the process, separated from each other by cutting. The base plane 2 of the contactor 1 is thus constituted by a rectangle of silicon cut in the plate having been used in the fabrication of the lot of contactors. According to another embodiment of the present invention, the silicon plate may be replaced by a glass plate.

The base plane 2 comprises a superficial layer (the presence of which is indicated by a thickening of the hatching on the drawings, and is referenced 10) formed of silicon dioxide and thus being electrically isolating. It can further be seen from FIG. 1 that the base plane comprises on its upper-face, two distinct electrically conducting zones 12 and 13 constituted by metallisation tracks. As will be explained in further detail below, these metallisations zones are, according to the prefered embodiment of the present invention, constituted by two distinct metal layers deposited successively on the substrate. It will further seen from FIG. 1 that, as has been already said, the two beams 19, 21 are each fixed on a foot 15, 17 and in addition these two feet are fixed on the base plane 2 at the level respectively of the two metallisation tracks 12 and 13. The two beams 19, 21 extend horizontally in an unaligned manner from the apex of the two feet 15, 17 and constitute therewith two electrode structures 4, 6 each realised in a single piece.

Still considering the present embodiment, the two electrodes are oriented in such a manner that the distal parts of the beams extend in a common direction, or more precisely the beams 19, 21 both extend in the vertical plane which contains the feet 15, 17 of the electrodes. The electrodes 4, 6, as will be seen further on, are realised by galvanic growth of a ferromagnetic alloying preferably of iron and of nickel. The reed contactors according to the invention may have dimensions considerably smaller than those which have been given further above in relation to the contactors of the prior art. In the embodiment described here of a reed contactor according to the invention, the first electrode 6 may have a height of typically between 20 and 35 μm, whilst the second electrode 4 may have a height of between 40 and 70 μm. Each of the electrodes may typically have a length of 500 μm (for the flexible part) and a width of 500 μm. The overlapping of the two electrodes may typically extend for a length of 40 μm and the vertical distance separating the two distal extremities of the electrodes may typically be between 10 and 15 μm in a rest position, that is to say more precisely in the absence of a magnetic field. The thickness of the beams 19 and 21 may be also between 10 and 15 μm so as to permit a certain flexibility of the beams 19 and 21. The beams that have just been described have thus the form of long, flexible rectangular blades which are disposed substantially in the extension of each other. In the presence of an exterior magnetic field oriented parallel to these blades, these last will become magnetised and an attractive magnetic force will appear between the two extremities of the blades which are next to each other. The blades having a small thickness with respect to the length and thus being relatively flexible, the attractive force will bring the two extremities into contact with each other. In these conditions, the two metallisation tracks 12 and 13 will be electrically connected to each other and the contactor will thus be closed.

The mixture of iron and of nickel used for the realisation of the electrodes has preferably a weak magnetic hystereses such that when the exterior magnetic field disappears, the magnetisation of the two beams 19 and 21 also disappears and their two distal extremities cease to be attracted to each other. In these conditions, the elasticity of the metal recalls the beams towards their rest position in which the two metallisations tracks 12 and 13 are no longer connected electrically.

The description of the present embodiment of the contactor according to the invention will now be completed by describing a particular mode of working of each of the two processes of the present invention which allow the realisation in an advantageous manner of the reed contactor of the present invention.

As has been said, the present mode of working of the process allows the fabrication of reed contactors by lots or batches on a plate of silicon which is finally cut to separate the contactors produced from each other.

FIGS. 3 to 18 which describe the steps of the process of fabrication only show a single contactor, but of course these figures are in fact partial views of a plate on which many contactors are arranged next to each other, a single one of these being visible in the partial side-view.

Figure 3:
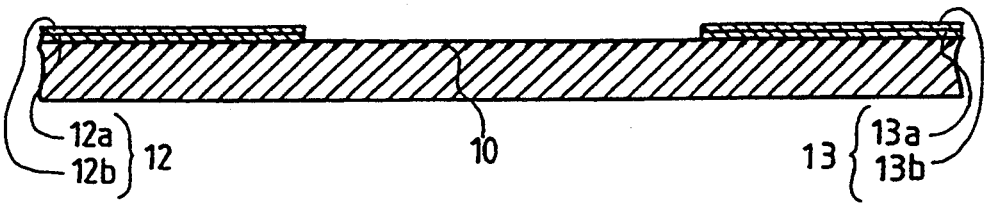
FIGS. 3 to 18 are cross-sectional side views of the contactor of FIG. 1 at different steps of its fabrication according to a particular mode of working the first process of the present invention.

A layer of silicon dioxide 10 is firstly created on the surface of the silicon 2 by oxidisation of the plate in an oven in a presence of oxygen. This first operation provides an isolating substrate on which is then created, during a second step, distinct conducting zones 12, 13. According to a variation, the isolating substrate on which are created the conducting zones, may also be a glass plate. The conducting zones created on the glass or on the silicon dioxide are configured in such a way that they are isolated from each other once the contactors formed on the plate have been separated from each other. These conducting zones are realised by creating on the oxydised silicon the metallisation tracks 12, 13 according to what is represented in FIG. 3. In the present embodiment, a thin layer, called a bumping layer of approximately 40 nm thickness, in titanium **12*a* and 13*a* is firstly deposited on the entire surface of the plate by thermoevaporation. The use of titanium is particularly advantageous since this metal adheres well to the silicon dioxide. A metallisation of gold 12*b* and 13*a* is then preferably deposited on the titanium to improve the efficiency of the electrodeposition. This last layer of metallisation deposited by thermoevaporation is extremely thin (approximately 200 nm). The two metallisation layers thus produced are then etched according to a classical technique to produce a network of conducting tracks 12,13. At this point of the fabrication process, the contactor resembles what is represented in FIG. 3**. The conducting tracks are preferably connected on the isolating plate not yet cut. In fact, when during the course of a subsequent step of the procedure, an electro deposition is effected on these conducting tracks, they should each be maintained under a voltage with the aid of a power supply. The fact of foreseeing a configuration in which the metallisation tracks are connected has thus the advantage of allowing them to be all placed simultaneously under voltage with the aid of the same electrical connection.

The configuration operation of the metallisation which has just been described may be followed, if necessary, by a step of dehydration of the substrate. In the present example, the dehydration will last typically thirty minutes at a temperature of 220° C.

Once the substrate is dehydrated, a first layer of photoresist 23 is deposited on the surface of the plate. The photoresist is preferably deposited by centrifugation. In the represented embodiment, this layer of photoresist is intended notably, as would be seen further on, to play the role of sacrificial layer extending between the substrate and the first suspended level of the structure to be realized, that is to say the electrode 6 of the future contactor. The thickness of the first layer of photoresist may be for example 2 μm.

The layer of photoresist which has just been deposited is then baked. In the present example, the baking is realized in two steps, a first step of thirty minutes at 65° C., following by a second step of fifteen minutes at 80° C.

The photoresist is then configured with the aid of a second mask (not represented) to clear, above the metallisation tracks 12, ]3, openings 25, 26, 27 and 28 called moulding holes at the location where the galvanic growth will subsequently take place. The metallic blocks which will be thus formed in the moulding holes 25 and 28 will constitute the two contact pins 56 permitting the connection of the reed contactor to an exterior electronic circuit, whilst the two metallic blocks which will be formed in the moulding holes 26, 27 will constitute respectively the base of the foot 15 and the foot 17.

Figure 4:
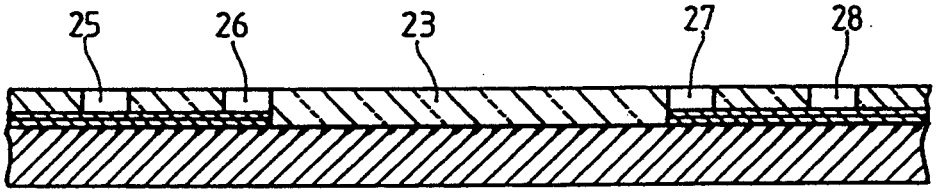
Figure 5:
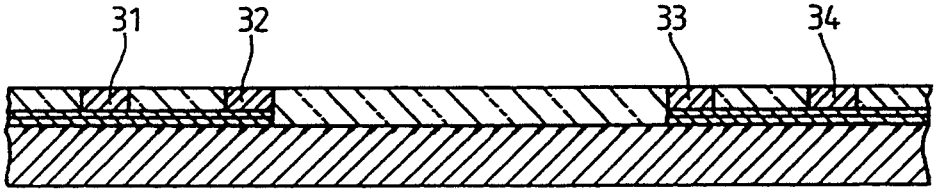

Once the photoresist is configured, the future contactor resembles what is represented in FIG. 4. Next, metallic blocks 31, 32, 33 and 34, of an alloy of iron and nickel or of gold, for example, are grown by electrodeposition in the orifices 25, 26, 27 and 28 provided in the thick photoresist. The photoresist thus plays at this stage the role of mould. At the end of the galvanic growth, the substrate resembles what is represented in FIG. 5.

Figure 6:
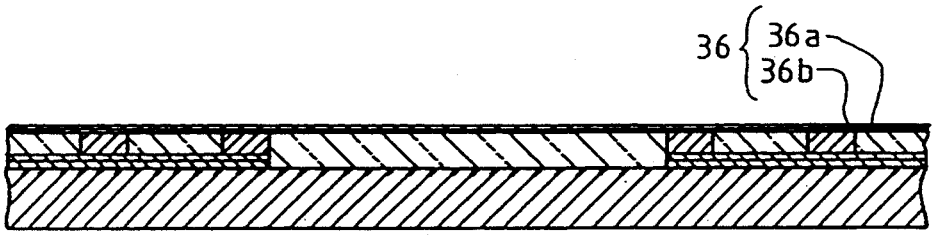

A new extremely thin double metallisation **36*a*, 36*b* formed by a bumping layer in titanium covered by a layer of gold is then deposited by thermic evaporation on the entire surface of the plate according to what is represented in FIG. 6**.

Figure 7:
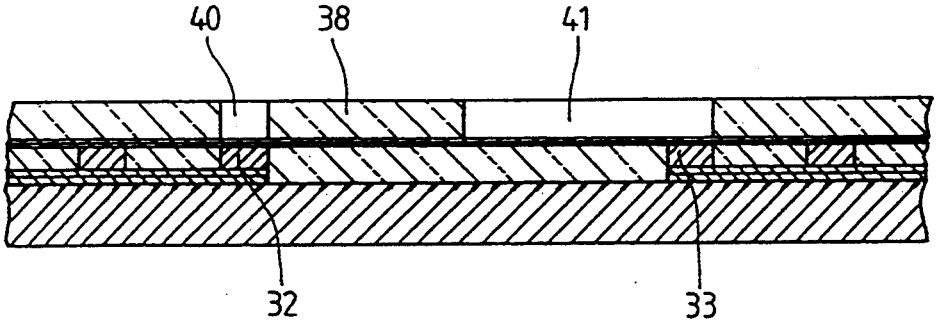

A new thick photoresist 38 is then deposited on the second metallisation and configured to form a mould intended to receive a second electrodeposition. The second layer of thick configured photoresist is represented in FIG. 7. The moulding holes 40, 41 provided in the thick photoresist 38 do not extend exactly vertically from the metallic blocks 32, 33 which have been formed in the first layer of photoresist 23. It should be noted more particularly that the moulding hole 31 extends further above the metallic block 33, the first layer of photoresist 23 thus now playing the role of sacrificial layer permitting the realisation of suspended structures.

Figure 8:
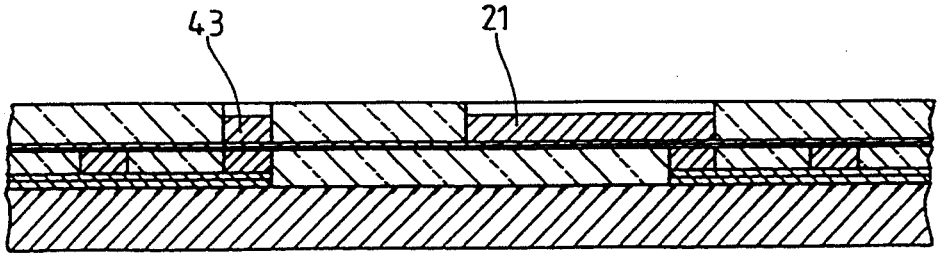
Figure 9:
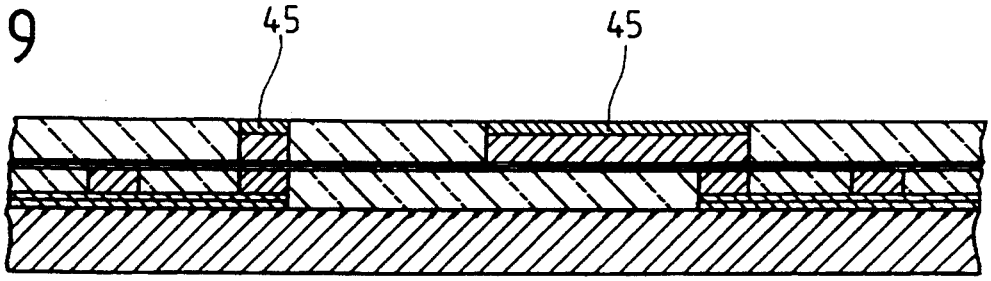
Figure 10:
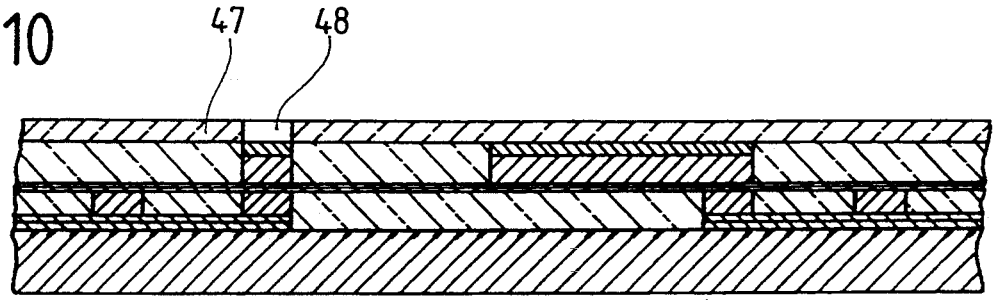

Next, an electrodeposition of a ferromagnetic material of iron-nickel for example is realized in the orifices 40, 41 provided in the second layer of photoresist 38 to constitute, firstly, a second stage 43 for the foot 15 of the second electrode 4 and, secondly, the beam forming the first electrode 6. The galvanic growth is stopped before the alloy of iron-nickel has attained the level of the surface of the photoresist 38. FIG. 8 represents the plate at this stage of the process. It should be specified that, in a general manner according to the process of the present invention, a superposition, even partial, between the metallic blocks formed by galvanic growth in the layer of photoresist and those formed in the following layer is not necessary. The metallic structure formed in the upper layer may be, should the case arise, entirely suspended or free.

Next, one deposits, on the iron-nickel and always by galvanic growth, a thickening of gold 45 intended to improve the electric contact between the two electrodes 4, 6 when the distal parties 19, 21 touch each other during the operation of the contactor. One can see from the FIG. 9 the state of the contactor once the deposit of the thickening of gold is finished.

A third layer of thick photoresist 47 is next realized on the entire surface of the plate. The thickness of the photoresist deposited during this step is equal to the gap separating the two beams 19, 21 in the sense of the height of the finished contactor 1. This third layer of photoresist 47 is also configured to realize a moulding hole 48 intended to receive in the following step the third level of the foot 15 of the second electrode 4. The third level of configured photoresist 47 is visible in FIG. 10.

Figure 11:
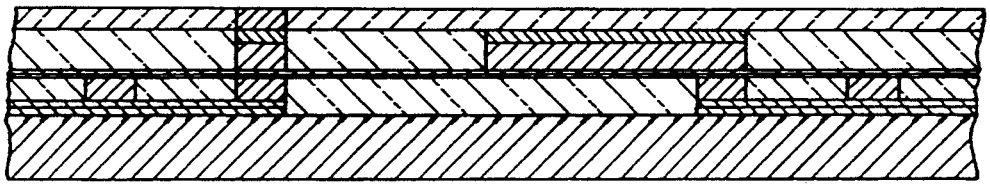
Figure 12:
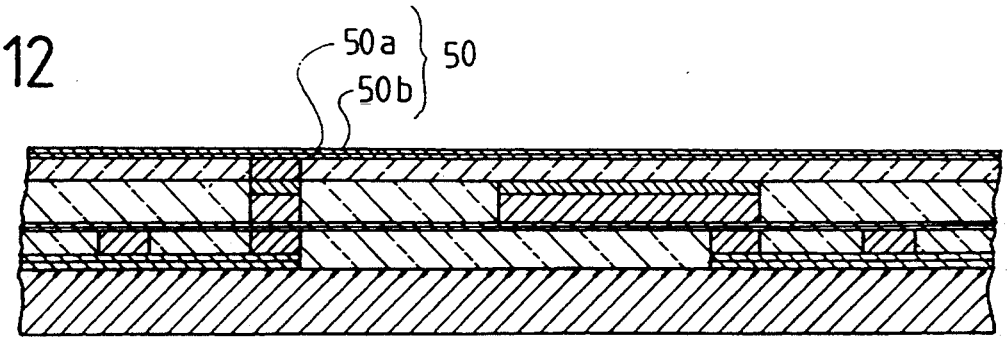
Figure 13:
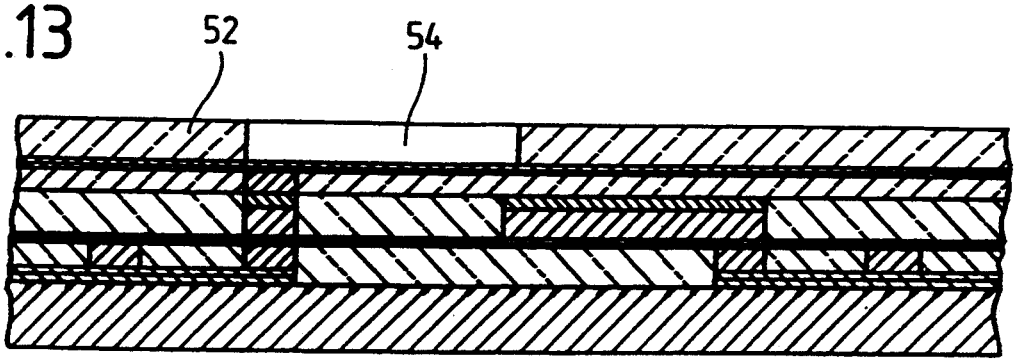

A third electrodeposition of iron-nickel or of gold for example is next realized in the interior of the orifice formed in the photoresist according to what is represented in FIG. 11.

A new thin double layer of titanium and of gold **50*a*, 50*b* is next realized on the entire area of the plate. The photoresist is thus configured to realize a orifice 54 for the moulding of the beam 19 forming the second electrode 4 which will be also realized by electrodeposition in a subsequent step. The fourth layer of configured photoresist 52 is also visible in FIG. 13**.

Figure 14:
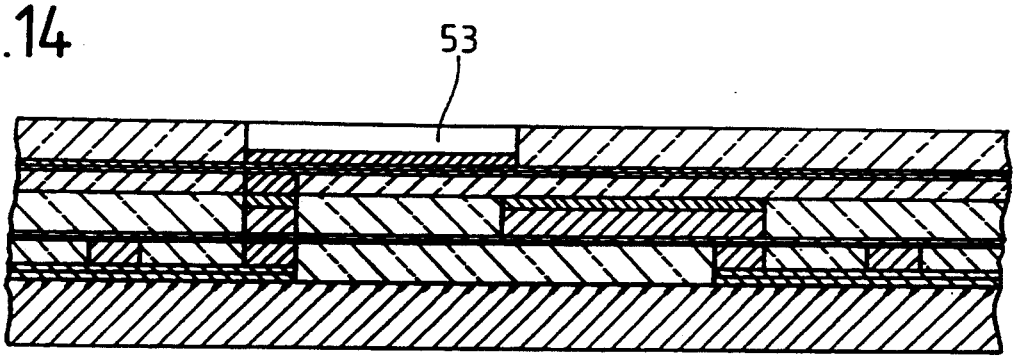

A layer of gold 53 is firstly constituted by electrodeposition in the bottom of the moulding hole 54 formed in the photoresist 52. This layer of gold 53 constitutes a thickening of the beam 19 forming the second electrode 4 which would serve as the gold thickening 45 which has been previously realized on the beam 21 forming the first electrode 6 to improve the electrical contact therebetween. FIG. 14 represents the contactor at the end of the step of the deposition of this second thickining of gold.

Figure 15:
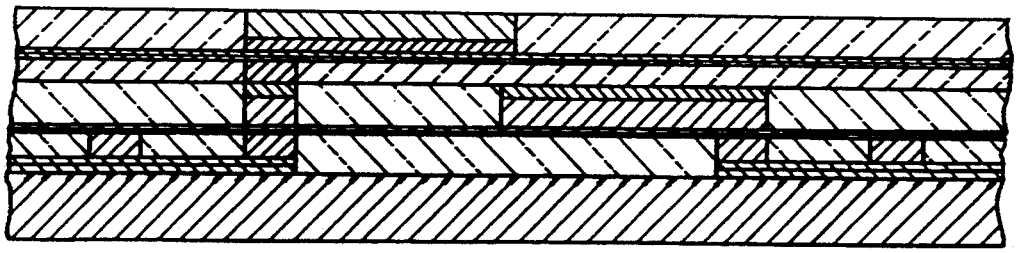
Figure 16:
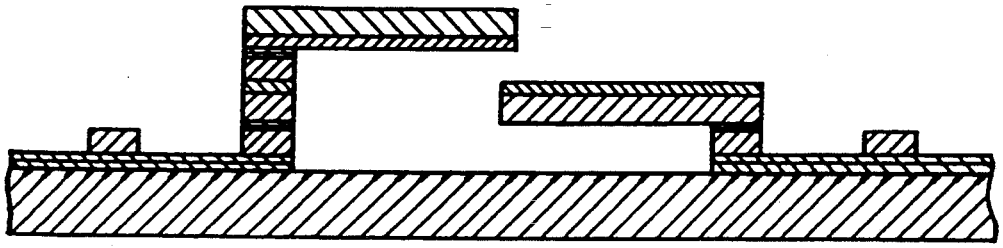

The core of iron-nickel of the beam 19 forming the second electrode 4 is next realized by a final electrodeposition. FIG. 15 represents the reed contactor 1 according to the invention once all the steps of electrodeposition have been terminated. The separation between the two electrodes 4, 6 being in this embodiment determined uniquely by the thickness of the third layer of thick photoresist, it will be possible to produce contactors with extremely small tolerances in the positioning of the electrodes.

Figure 17:
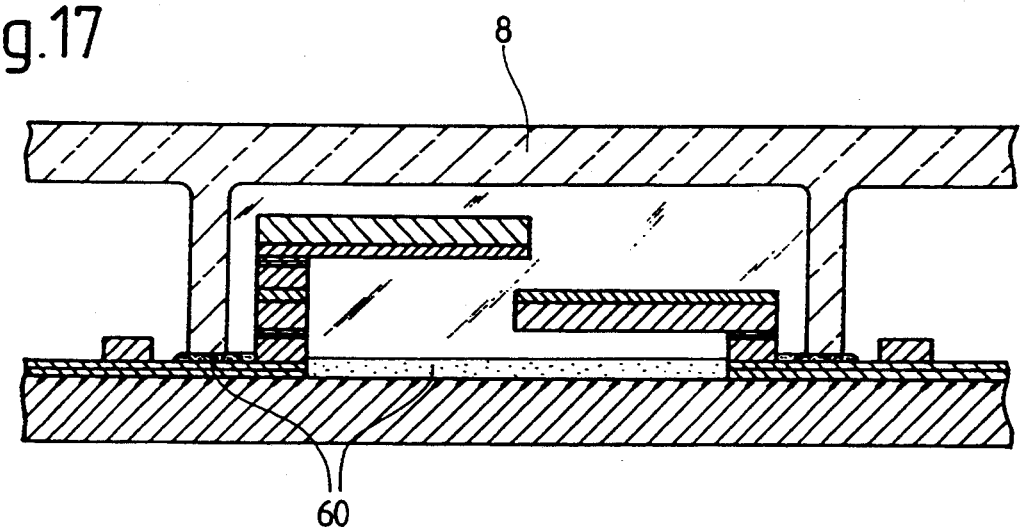
Figure 18:
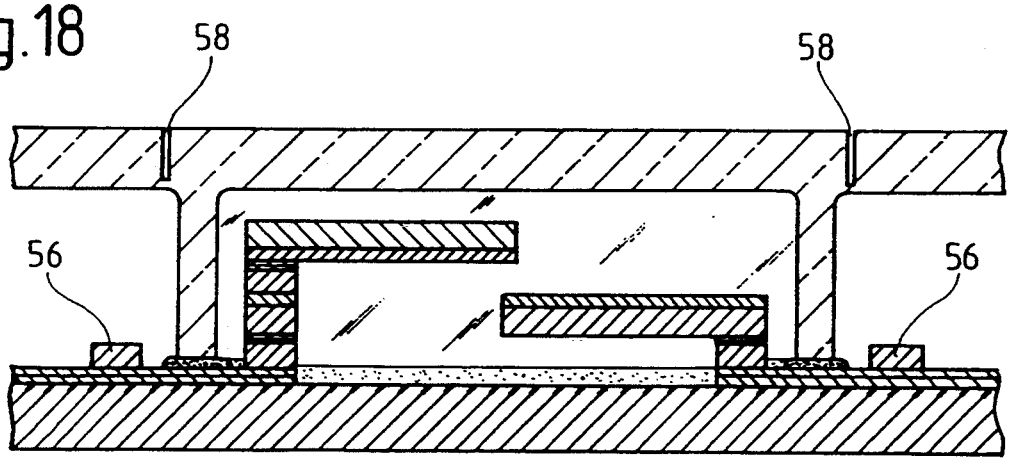

The contactor is then submitted to a reactive attack to free, either in a single operation or by stages, the two electrodes 4, 6 and thus to eliminate the layers of photoresist 23, 38, 47 and 52 as well as the metallisation of gold and of titanium 36 and 50. One sees in FIG. 16 the two electrodes 4, 6 of the finish contactor. The electrodes 4, 6 being essentially realized in a alloy of iron-nickel, they are ferromagnetic and thus strongly magnetizable. The realisation of the beams 19, 21 according to the process by successive layers which has just been described allows a determined thickness to be given thereto. This thickness is chosen so as to provide the flexibility necessary to permit the two beams at their distal extremities to touch each other in a presence of a relatively weak magnetic field. To avoid all risk of oxidation of the alloy of iron-nickel, the electrodes are next placed in a hermetic chamber filled with an inert gas. To this effect, a honeycombed cap 8 is affixed to the plate, this cap being realized for example in micromachined glass which once affixed to the plate encloses each pair of electodes 4, 6 in an individual cell (the thickness of fixant joining the cap to the substrate is referenced 60 in FIG. 17). FIG. 17 partially represents the plate on which the honeycombed cap 8 has been affixed.

At this stage of the realisation, a single plate covered by a cap 8 comprising a multiplicity of cells (only one fragment of this assembly being represented in FIG. 17) regroups an entire lot of contactors. The assembly of the plate and of the cap thus defines a multiplicity of cavities of which approximately half enclose the pair of electrodes of a contactor, whilst the other cavities enclose contact pins 56.

The exact distribution of the contactors and the contact pins 56 in the different cells naturally depends on the particular form of the masks used for the configuration of the layer of photoresist. The lot of the assembled contactors must now be cut to separate the contactors from each other.

This operation is preferably effectuated in two steps. In a first step the material of the cap is notched to a sufficient depth to make it easily breakable. This operation produces the nicks 58 visible in FIG. 18. Once this operation is effectuated the plate is, in a second step, cut to separate all the individual contactors from each other. Once the separation of the different contactors is realized, it is easy to break the fragments of the cap which are situated above each of the contact pins 56 since these fragments have already been notched during the first step of cutting. Once these fragments of caps are removed, the contact pins 56 are easily accessible to realize the connection of the finish contactor with an exterior electric circuit. The step of cutting which has just been described supplies typically several thousands of contactors from one plate having a diameter of 10 cm.

Figure 19:
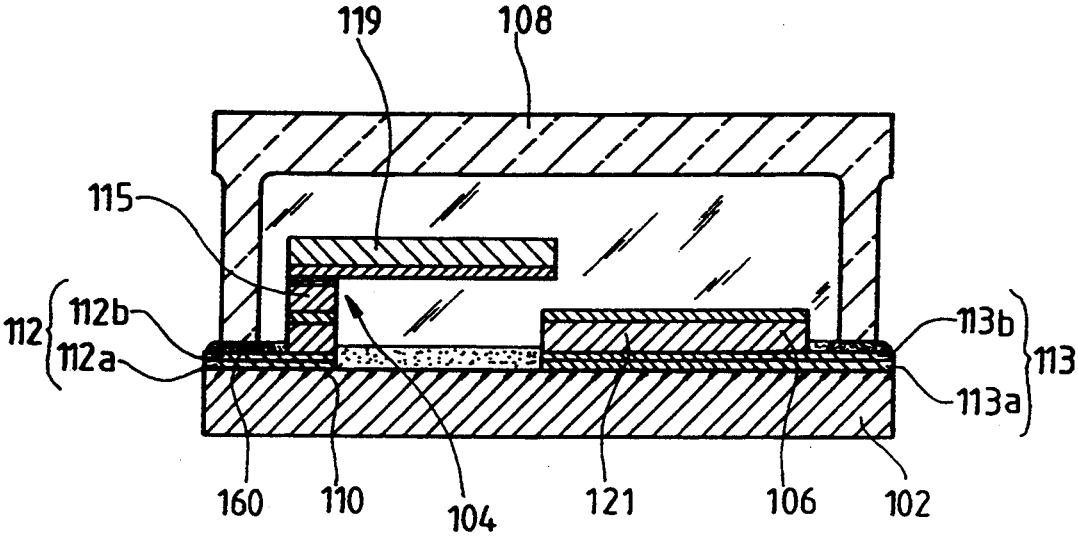
FIGS. 19 to 20 are respectively cross-sectional side and plan views of a "reed" contactor according to a second embodiment of the present invention.
Figure 20:
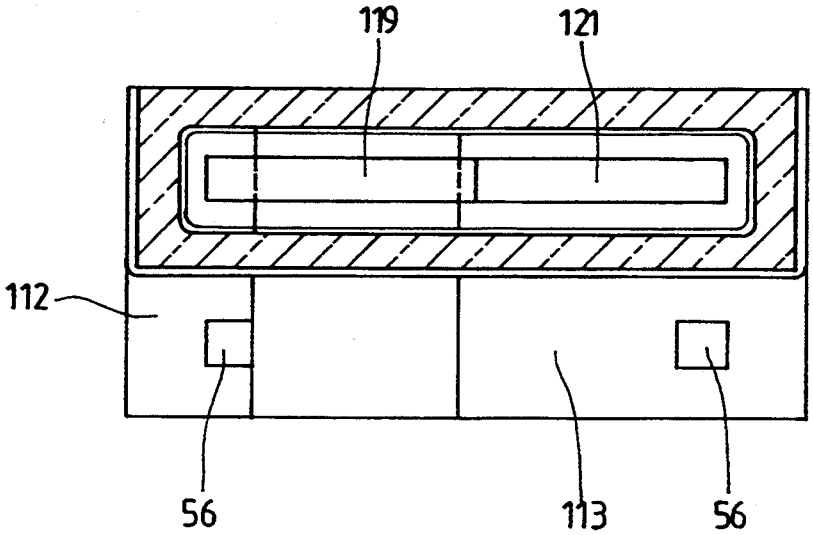

FIGS. 19 and 20 represent a reed contactor according to a second embodiment of the present invention. In this second embodiment the beam 121 forming the first electrode 106 is directly fixed to the conducting track 113 of the substrate 102, as opposed to the second electrode 104, the electrode 106 does not thus comprise a foot. In this mode of realisation, only three layers of thick photoresist are used for the fabrication of the contactor in place of four in the embodiment described above. The first electrode 106 being evidently not flexible in the present embodiment, the beam 119 of the second electrode 104 must itself have sufficient flexion in the presence of an exterior magnetic field to close the contactor.

Figure 21:
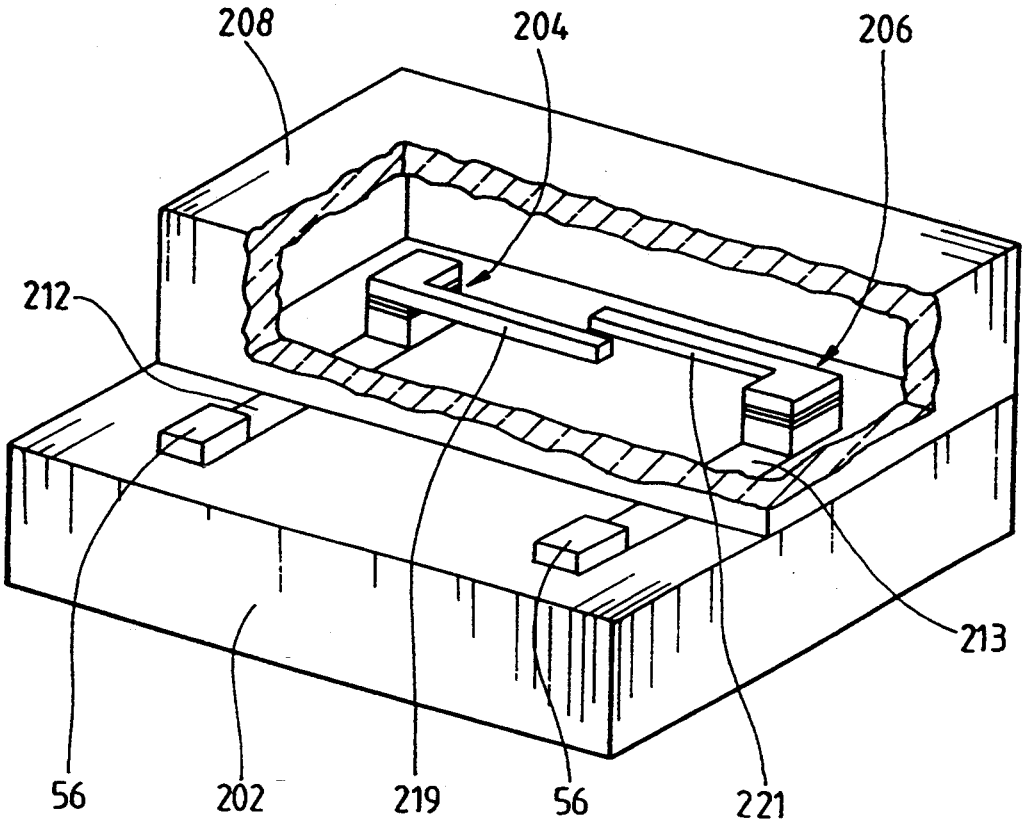
FIG. 21 is a partially cut-away perspective view of a "reed" contactor according to a third embodiment of the present invention.
Figure 22:
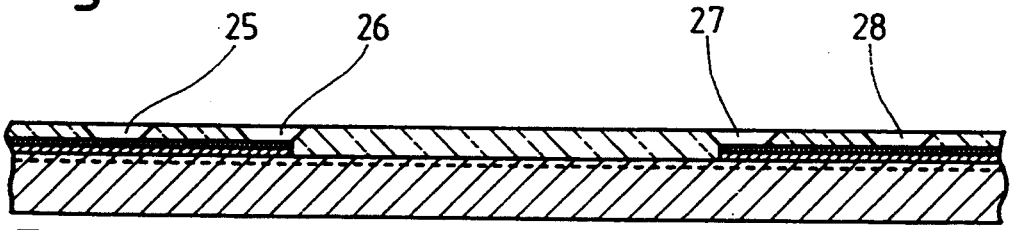
FIGS. 22 to 33 are cross-sectional side views of a contactor according to the present invention at different stages of its fabrication according to a particular mode of working the second process according to the present invention.
Figure 23:
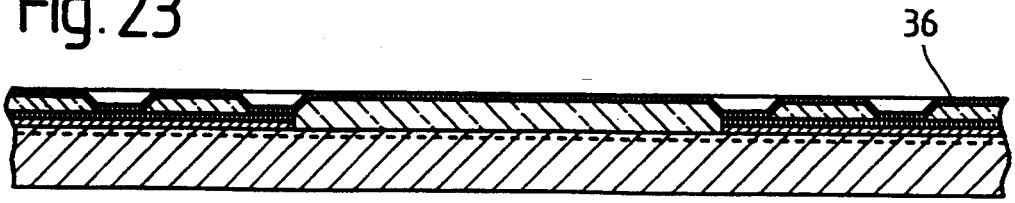

FIG. 21 represents a reed contactor according to a third embodiment of the present invention. As can be seen in this figure, in this embodiment the beam 209 of the electrode 204 and the beam 221 of the electrode 206 are disposed in the same plane parallel to the base plane 202. The flexion of the beams which produces the opening or the closure of the contactor are effectuated here laterely, that is to say parallel to the base plane 202. This variant of the invention has the advantage of requiring few deposition and configuration steps for its realisation.

Referring now to FIGS. 22 to 33, an example of the working of a second process of fabrication of suspended tridimensional metallic microstructure according to the present invention will be described. The particular mode of working described hereafter allows the realisation of the reed contactor according to the invention in a few number of steps than the number of steps necessary with the first process according to the present invention.

Until the step of exposing the first layer of photoresist 23 (FIG. 4) to ultraviolet radiation through a configuration mask, the steps of the present second process can be performed in an identical manner to those described above in relation with the example of working the first process.

Each manufacturer of photoresist supplies with its product exposure values recommended for the configuration. These recommended values are intended to obtain an aspect ratio of the reliefs of the photoresist which is the greatest possible once these are configured. If it is desired on the other hand to obtain a physical relationship which is relatively weak, it is not necessary to follow the recommendation of the manufacturer. The authors of the present invention have notably observed that with the photoresist known by the tradename Shipley Microposit ® R S1400-27, the fact of considerably exceeding the recommended exposure values permits the obtention of relatively weak aspect ratios corresponding to that which is necessary for the working of the present second process.

The photoresist is thus firstly exposed and then developed with the aid of a chemical attack agent, for example that known by the tradename Shipley Microposit ® 351 diluted in a proportion of (1:3). The substrate is then rinsed and rebaked, to supply the structure represented in FIG. 22. According to what is represented in the figure, the configured reliefs of the layer 23 have a relatively weak aspect ratio. In other words, the edges of the four openings 25, 26, 27 and 28 are pronouncedly inclined and not vertical. In the present example, it has been said that the weak relationship of appearance is due to the overexposure of the photoresist but it is obvious that many other means are imaginable to obtain this weak relationship of appearance (under-exposure, particular photoresist, etc.).

Once the photoresist is configured, a new metallisation of gold 36 is formed on its surface. Due to the weak aspect ratio of the walls of the openings 25, 26, 27 and 28, this metallisation can, as will be appreciated from FIG. 23, extend without interruption between the end of said openings and above the photoresist 23. This configuration permits the new metallisation 36 to be integrally in electrical contact with the metallisation tracks 12 and 13 formed on the substrate. This characteristic is necessary to allow the subsequent realisation of a electrodeposit on the metallisation 36.

Figure 24:
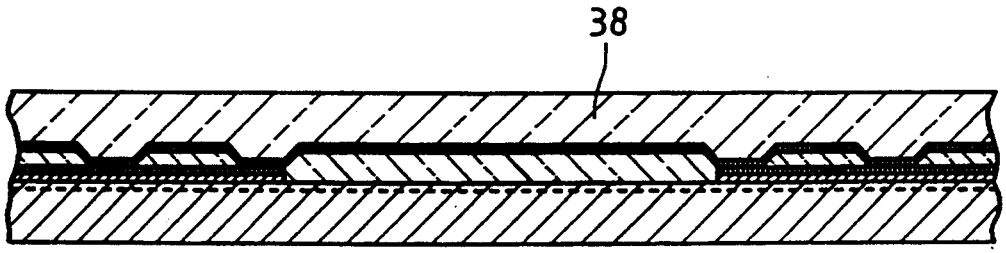
Figure 25:
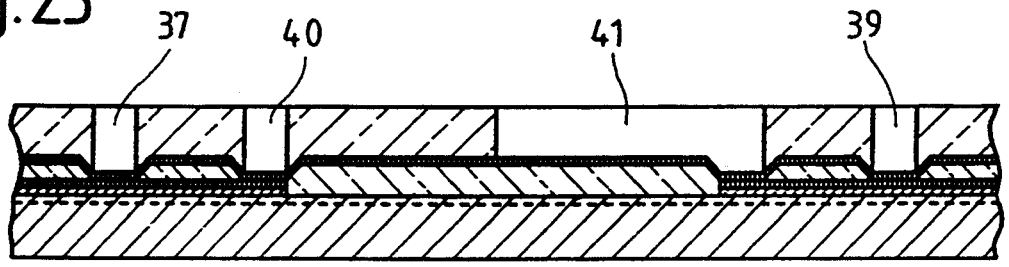
Figure 26:
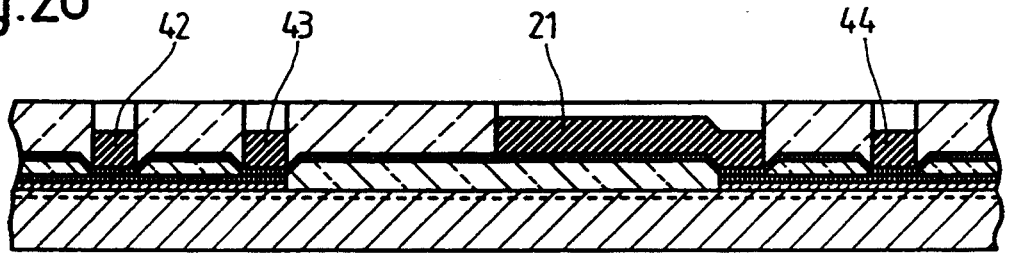
Figure 27:
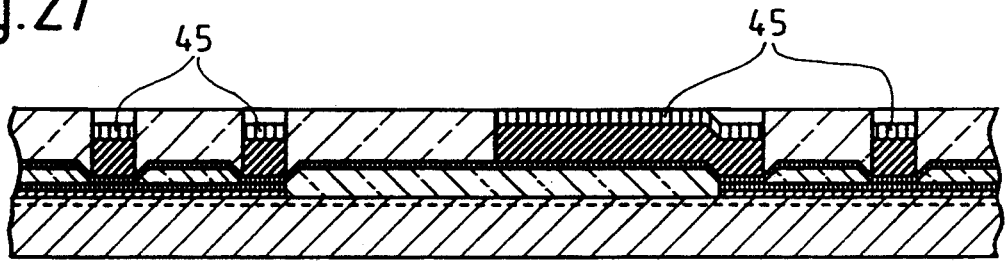
Figure 28:
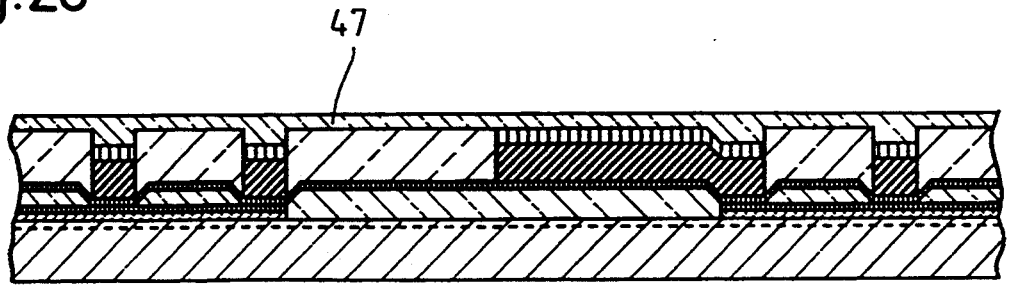

The next step is the laying-down of a first thick photoresist 38. Once this layer 38 is formed on the metallization 36, the plate resembles what is represented in FIG. 24. Next, a new configuration step is executed to realize the moulding holes 37, 38, 40 and 41 at the interior of which will be subsequently realized the galvanic growth. The walls of these moulding holes will preferably have, as opposed to the walls of the openings 25, 26, 27 and 28 described in the preceding step, a strong relationship of appearance. Once the thick photoresist is configured, the future contactor resembles what is represented in FIG. 25. Next a first series of metallic blocks 21, 42, 43 and 44 is grown by electrodeposition, from the metallization zones forming the end of the moulding holes 36, 37, 40 and 41. The photoresist plays thus at this stage the role of mould. At the end of the galvanic growth, the substrate resembles what is represented in FIG. 26. It would be noted in particular that the metallic block 21 extends over a certain length above the first layer of photoresist 23 which thus plays now the role of sacrificial layer permitting the realisation of the first suspended structure which constitutes, in the present example, the electrode 6 of the future contactor.

Next is deposited, on the iron-nickel and always by galvanic growth, a thickening of gold 45 intended to improve the electric contact between the two electrodes 4, 6 when their distal parties 19, 21 touch each other during the operation of the contactor. This thickening of gold may have a thickness of 0,5 μm. One sees in FIG. 27 the state of the contactor once the deposit of the thickining of gold is finished.

Figure 29:
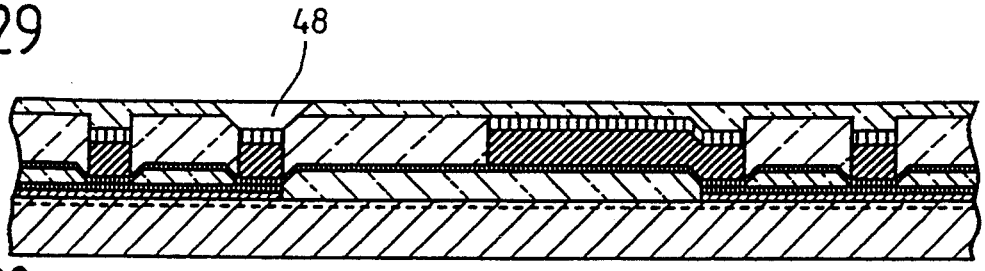

A third layer of photoresist 47 is next realized on the entire surface of the plate. The thickness of the photoresist deposited during this step is equal to the gap which separates the two beams 19, 21 in the sense of the finish contactor 1. This third layer of photoresist 47 is also configured so as to realize a vertical opening 48 in the block of metal 43 constituting the base of the foot 15 of the future electrode 4 of the reed contactor. As can be seen in FIG. 29, the walls of the opening 48 which has just been realized have also a weak aspect ratio.

Figure 30:
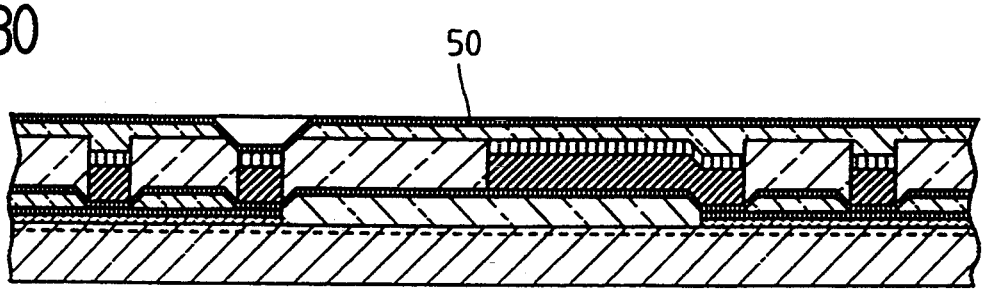
Figure 31:
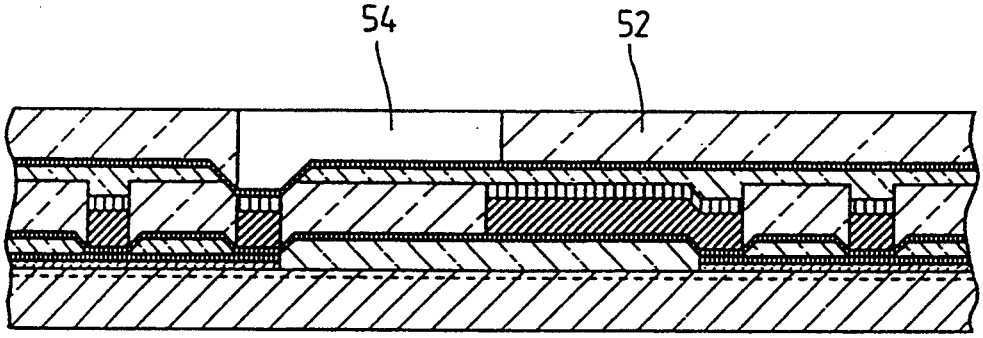

Once this step of configuration of the photoresist is finished, a new metallisation 50 is deposited on its surface. At this stage of the process, the structure corresponds to what is represented in FIG. 30.

A fourth layer of thick photoresit 52 is next realized over the entire surface of the plate. This photoresist is thus configured to realize a orifice 54 intended for the subsequent moulding of the beam 19 forming the second electrode 4 of the contactor. The fourth layer of the configured photoresist 52 is visible in FIG. 31. To realize the beam 19, one forms firstly, by electrodeposition, a layer of gold 53 in the bottom of the molding hole 54.

Figure 32:
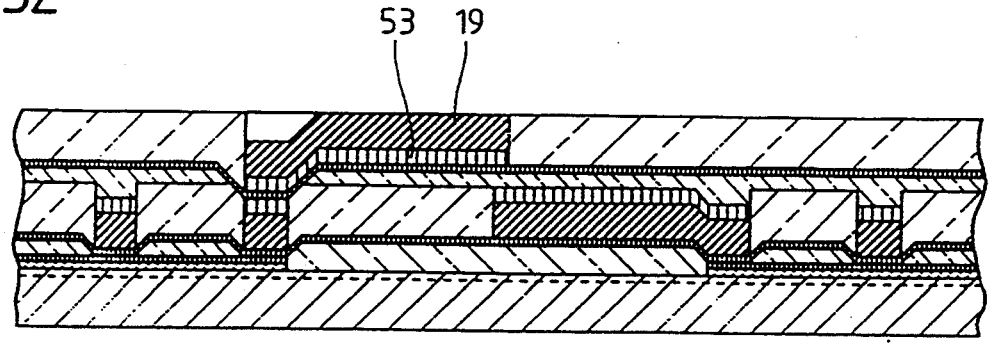
Figure 33:
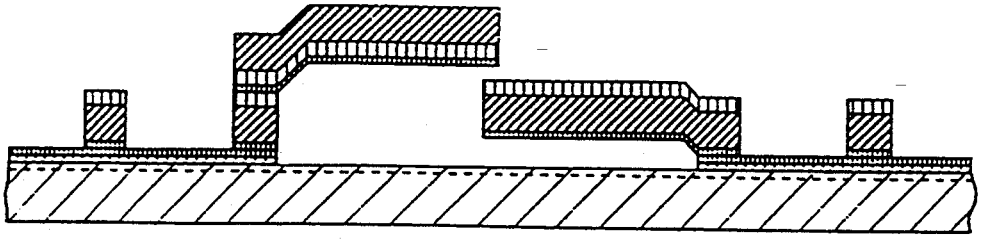

The core in iron-nickel of the beam 19 forming the second electrode 4 is next realized by a final electrodeposition. FIG. 32 represents the reed contactor 1 according to the invention, once all the steps of electrodeposit are finished. The layer of gold 51 which has been deposited before the alloy of iron-nickel now forms contact layer under the electrode 4 of the reed contactor. It should be further noted that the separation between the two electrodes 4, 6 is in the present embodiment determined solely by the thickness of the third layer of thick photoresist. It is thus possible to produce contactors with extremely small tolerances in the positioning of the electrodes.

The contactor is then submitted to an attacking reactant to free either in a single operation or by steps, the two electrodes 4, 6 and thus eliminate the layers of photoresist 23, 38, 47 and 52 as well as the metallisation of gold and of titanium 36 and 50. Once the electrodes are completely free, the contactor has the appearance represented in FIG. 33.

Finally, it shall be recalled that the reed contactor according to the invention may of course be realized according to a different process of micromachining from those of the present invention, and that reciprocally the processes of the present invention are not limited to the realisation of reed contactors, the scope of the present invention being defined by the independant claims attached hereto.

We claim:

1. Contactor including two conducting beams connected respectively to electrical connection means, said beams each comprising a distal extremity, said distal extremities being near each other and mobile with respect to each other between a first open position in which they are separated from each other by a space, and a second closed position in which they are in contact with each other, said contactor further comprising recall means for recalling said distal extremities towards said opened position, said beams being further realized at least partially in a magnetizable material such that when they are submitted to a magnetic induction field of sufficient intensity, said distal extremities are brought to said closed position, said contactor being characterized in that it comprises a base plane comprising two distinct electrically conducting zones, in that said beams engage said base plane at the level of said two conducting zones, and in that at least one of said beams is bound to said base plane by means of a foot on which it is mounted.

2. Contactor according to claim 1, characterized in that it comprises a cap which covers the beams and which is fixed to said base plane to form therewith a closed chamber, and in that said connection means are located on the exterior of said chamber.

3. A contactor comprising a planar base having first and second conducting zones on one face thereof, first and second conductive beams supported on said one face, each of said beams having a distal extremity, said distal extremities being near each other and at least one of said distal extremities being mobile with respect to the other between a first open position in which the distal extremities are separated from each other and a second closed position in which they contact each other, said beams comprising a magnetizable material whereby an applied magnetic field causes movement of said distal extremity of said first conductive beam from one of said positions to the other of said positions, said first conductive beam having a second extremity, a foot of conductive material for supporting said first conductive beam, said foot being bound at said second extremity to a surface of said first conductive beam that extends from said second extremity to the distal extremity of said first conductive beam, said foot extending normal to said surface of said first conductive beam and being bound to said first conducting zone whereby said first conductive beam is electrically connected to said first conducting zone through said foot, and said second conductive beam being electrically connected to said second conducting zone.

4. A contactor as claimed in claim 3 and further comprising a cap mounted to said one surface of said planar base to form a hermetically closed chamber in which said conductive beams are located, and electrical connection means external of said chamber and in electrical contact with said first and second conducting zones.

5. A contactor as claimed in claim 3 wherein said foot comprises multiple layers of thin films.

6. A contactor as claimed in claim 5 wherein at least one of said layers comprise a material different from material of others of said layers.

7. A contactor as claimed in claim 3 wherein said second conductive beam is bound to a second foot of electrically conductive material.

8. A contactor as claimed in claim 7 wherein said second foot is bound to said second conducting zone and extends normal to said second conductive beam and said one surface of said planar base.

* * * * *